US007959260B2

(12) United States Patent
Tsukuda et al.

(10) Patent No.: US 7,959,260 B2
(45) Date of Patent: Jun. 14, 2011

(54) INK JET RECORDING METHOD

(75) Inventors: Keiichiro Tsukuda, Yokohama (JP); Ken Tsuchii, Sagamihara (JP); Mineo Kaneko, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 544 days.

(21) Appl. No.: 11/959,126

(22) Filed: Dec. 18, 2007

(65) Prior Publication Data

US 2009/0015635 A1 Jan. 15, 2009

(30) Foreign Application Priority Data

Dec. 19, 2006 (JP) ..... 2006-341123

(51) Int. Cl.
*B41J 2/135* (2006.01)

(52) U.S. Cl. ..... 347/44; 347/56

(58) Field of Classification Search ..... 347/35, 347/40–43, 65–72, 92–94, 54, 56, 57, 61, 347/84–87

See application file for complete search history.

(56) References Cited

U.S. PATENT DOCUMENTS

| | | | | |
|---|---|---|---|---|
| 5,218,376 | A | 6/1993 | Asai | |
| 6,270,200 | B1 * | 8/2001 | Ishinaga et al. | 347/65 |
| 6,354,698 | B1 | 3/2002 | Tachihara et al. | |
| 7,108,352 | B2 | 9/2006 | Muraoka | |
| 7,549,734 | B2 | 6/2009 | Imanaka et al. | |
| 7,591,549 | B2 * | 9/2009 | Komplin et al. | 347/92 |
| 7,717,542 | B2 * | 5/2010 | Silverbrook | 347/54 |

FOREIGN PATENT DOCUMENTS

| | | |
|---|---|---|
| CN | 1191932 | 9/1998 |
| CN | 1223200 | 7/1999 |
| WO | 2006/051762 | 5/2006 |

* cited by examiner

*Primary Examiner* — Thinh H Nguyen
(74) *Attorney, Agent, or Firm* — Canon USA Inc IP Division

(57) ABSTRACT

A method for discharging liquid from a recording head including a first discharge port configured to discharge a liquid, a second discharge port configured to discharge a liquid, an amount of which is smaller than an amount of the liquid discharged from the first discharge port, and a substrate including a first heating element corresponding to the first discharge port, a second heating element corresponding to the second discharge port and the liquid supply port, wherein a distance between the liquid supply port and the second heating element is longer than a distance between the liquid supply port and the first heating element, and wherein discharge of the liquid from the first discharge port is performed by a discharge method in which a bubble formed by the first heating element communicates with atmosphere and an amount of the liquid discharged from the second discharge port is less than 2 pico liters.

7 Claims, 8 Drawing Sheets

INK JET RECORDING METHOD

BACKGROUND OF THE INVENTION

1. Field of the Invention

The present invention relates to an ink jet recording method used for recording an image by discharging liquid from a recording head. More particularly, the present invention relates to an ink jet recording method used for recording an image by discharging ink droplets to a recording medium from an ink jet recording head.

2. Description of the Related Art

An ink jet recording head of an ink jet recording apparatus has a heating element arranged in a recording liquid chamber. An electric pulse (i.e., a recording signal) is applied to the heating element to generate heat. Thermal energy generated by the heat causes a phase change in the ink and produces bubbles (or the ink boils). The ink liquid is discharged from a discharge port owing to a pressure generated at this time, and recording is performed on a recording medium.

In recent years, there is a demand for an ink jet recording apparatus having an ink jet recording head which is capable of producing photo quality prints at a higher speed. In addition, competition among manufacturers to lower the price of the ink jet recording apparatus is getting severe and it becomes important to manufacture products at a low cost.

U.S. Pat. Nos. 5,218,376 and 6,354,698 discuss methods for stably discharging smaller ink droplets from an ink jet recording head, which contributes to high-quality image printing. In these methods, a bubble generated by an energy generation element, which discharges the ink from the ink jet recording head, is in communication with the atmosphere.

Further, U.S. Pat. No. 7,108,352 discusses a method for manufacturing an ink jet recording head at a low cost, the recording head being configured to discharge a small droplet at a higher speed. According to U.S. Pat. No. 7,108,352, nozzles are arranged on an ink jet recording chip at a high density, and ink droplets of various discharge amounts are discharged from the ink jet recording head.

In such an ink jet recording head, relatively small ink droplets are used for a highlighted area of a recording image and larger ink droplets are used for a dark image area. As a result, high-speed and high-quality image printing can be achieved at the same time.

In order to manufacture such an ink jet recording head at a low cost, it is useful that the nozzles capable of discharging various amount of ink are formed on one ink jet recording chip. Further, in order to realize low cost manufacturing, it is useful that a nozzle plate used for forming the nozzles has even thickness. In other words, it is useful that a distance from the energy generation element for discharging ink to a top of the nozzle plate is kept constant for each of the nozzles that discharge different amounts of ink.

However, a problem arises in manufacturing the ink jet recording head that satisfies the afore-described features. In particular, when the nozzle density is increased to 900 dots per inch (dpi) or more and the distance between the liquid supply port and the heater (hereinafter referred to as CH distance) is changed, a refill frequency of the nozzles that have relatively long CH distance becomes low. The term, refill frequency, is the frequency that a temporarily emptied recording liquid chamber is refilled with ink again.

In such a case, in order to perform the refill at a high frequency as much as possible, it is useful that the CH distance of the nozzles, which discharge a relatively small amount of ink, is longer than the CH distance of the nozzles, which discharge relatively a large amount of ink. This is because, in the case of the nozzles that discharge a larger amount of ink, the amount of retreat of the liquid to the liquid supply port increases at the time of bubbling. Therefore, if the CH distance of the nozzles that discharge a larger amount of ink is long, the refill frequency is lowered, which may result in a faulty ink supply.

It is assumed, for example, that nozzles discharging a 2-pico liters (pl) ink droplet and nozzles discharging a 1-pl ink droplet are arranged alternately (staggered arrangement), and both nozzles discharge ink while a bubble generated by an energy generation element communicates with the atmosphere. In such a case, a longer CH distance is useful for the nozzles discharging a 1-pl ink droplet according to the above described viewpoint.

However, contrary to the above-described viewpoint, there happens to be a case where the refill frequency of the nozzles discharging a 1-pl ink droplet becomes lower than the refill frequency of the nozzles discharging a 2-pl ink droplet. This may cause a negative impact on high-speed recording.

SUMMARY OF THE INVENTION

The present invention is directed to an ink jet recording head which discharges different amounts of ink droplet and can perform a high-speed and high-quality image printing.

According to an aspect of the present invention, a method for discharging liquid from a recording head includes a first discharge port configured to discharge liquid supplied from a liquid supply port, a second discharge port configured to discharge a liquid, an amount of which is smaller than an amount of the liquid discharged from the first discharge port, and a substrate including a first heating element corresponding to the first discharge port, a second heating element corresponding to the second discharge port and the liquid supply port, wherein a distance between the liquid supply port and the second heating element is longer than a distance between the liquid supply port and the first heating element, a discharge of the liquid from the first discharge port is performed by a discharge method in which a bubble formed by the first heating element communicates with an atmosphere, and an amount of the liquid discharged from the second discharge port is less than 2 pico liters and discharge of the liquid from the second discharge port is performed by a discharge method in which a bubble formed by the second heating element debubbles without communicating with the atmosphere.

According to another aspect of the present invention, a relatively small droplet can be discharged at a high frequency and a relatively large droplet can be discharged with a fluctuation in the amount of discharge being controlled. Thus, an ink jet recording method which contributes to high-speed and high-quality image recording can be realized.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

First Exemplary Embodiment

Figure 2:
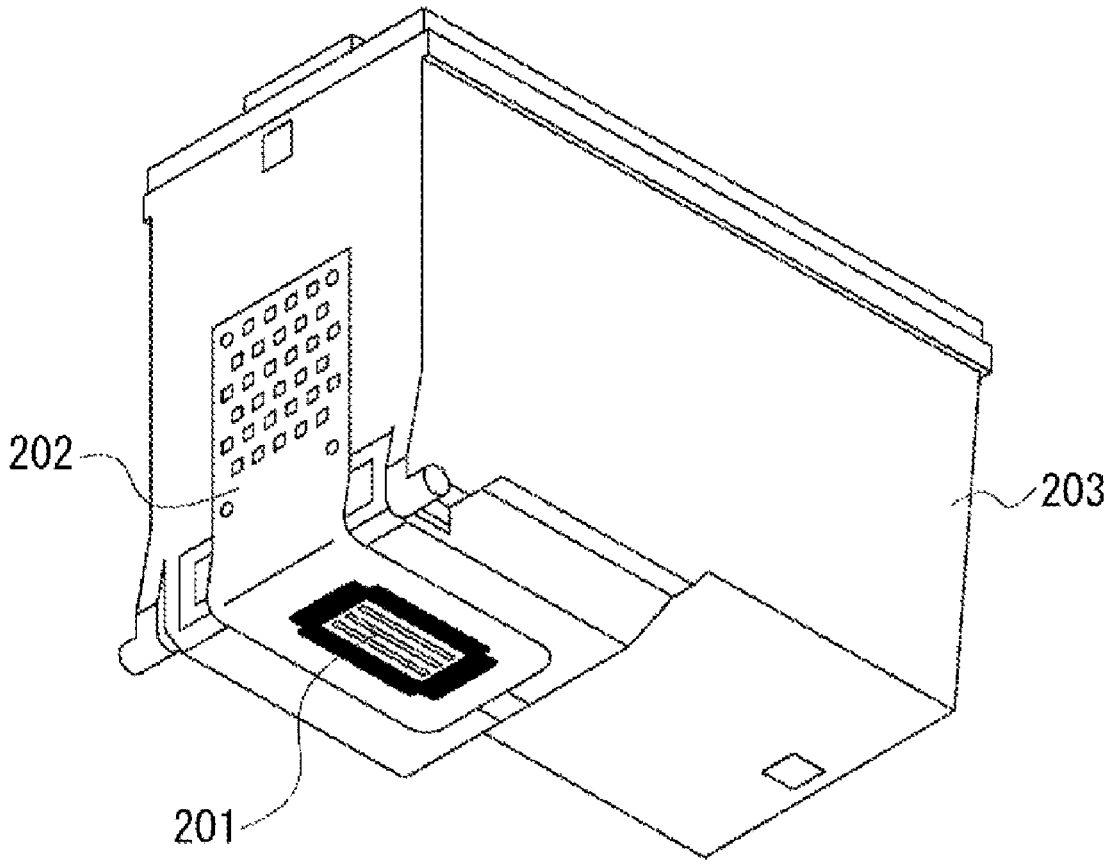
FIG. 2 is a perspective view of an ink jet recording cartridge according to an exemplary embodiment of the present invention.

FIG. 2 is a perspective view of an ink jet recording cartridge according to a first exemplary embodiment of the present invention. In FIG. 2, an electric wiring tape 202 is configured to transmit an electric signal from an ink jet recording apparatus to an ink jet recording chip 201. A housing 203 includes the ink jet recording chip 201 and an ink container. The ink container houses ink (liquid) that is supplied to a discharge port arranged on the ink jet recording chip 201 and configured to discharge an ink droplet.

The ink jet recording chip 201 of the present embodiment includes a heater (also referred to as a heating element), which is an energy generation element configured to discharge ink. Further, the ink jet recording chip 201 includes a recording element substrate made of silicon having wiring that transmits an electrical signal from the ink jet recording apparatus to the heater. A channel and an orifice plate are arranged on the recording element substrate. Each channel corresponds to the heater and is configured to supply ink. The orifice plate includes a discharge port used for discharging ink.

Furthermore, according to the present embodiment, the ink jet recording chip 201 includes a nozzle array that discharges ink of three colors, i.e. cyan, yellow, and magenta. A liquid supply port used for supplying ink from the ink container to the nozzle array is provided for each nozzle.

Figure 3:
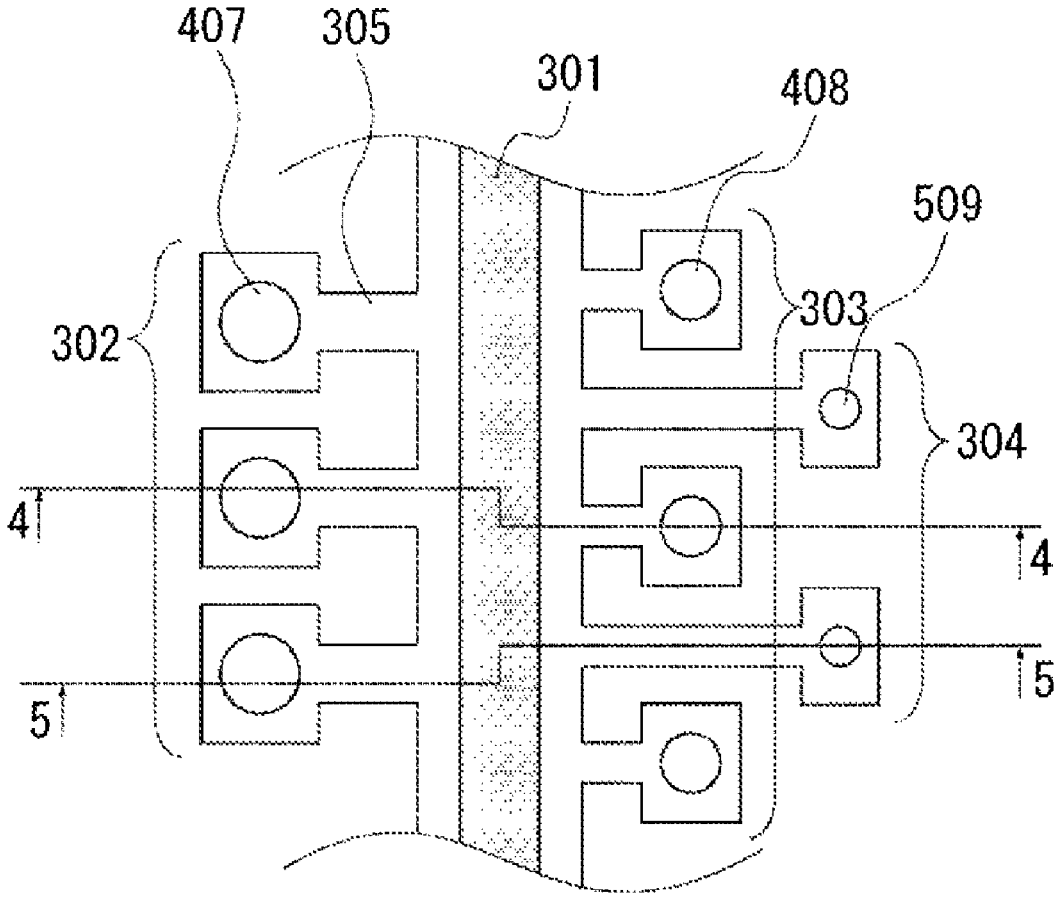
FIG. 3 illustrates a recording head according to the first exemplary embodiment of the present invention.

FIG. 3 is an enlarged plan view of the ink jet recording chip 201 illustrated in FIG. 2 and illustrates a part of the nozzle array for one of the colors. The ink jet recording chip 201 includes liquid supply port 301. Although the present embodiment uses a nozzle 305 adapted to discharge three different amounts of ink and discharge ports 407, 408, and 509, the present invention is not limited to such a configuration. The present invention can include other kinds of configurations for discharging ink or liquid.

According to the present embodiment, a nozzle array group 302 discharges a 5-pl ink droplet, a nozzle array group 303 discharges a 2-pl ink droplet, and a nozzle array group 304 discharges a 1-pl ink droplet.

According to the present embodiment, since the nozzle array group 302 discharges a relatively large 5-pl ink droplet, a heater 403 (FIG. 4) and the discharge port 407 for the nozzle array group 302 are relatively large, and thus arranged at intervals of 600 dpi. In order to minimize the size of the ink jet recording chip and arrange the nozzles at a higher density, the nozzle array groups 303 and 304 are disposed in a so called staggered arrangement in which a nozzle discharging a 2-pl ink droplet and a nozzle discharging a 1-pl ink droplet are alternately arranged. Further, according to the present embodiment, the nozzle array groups 303 and 304 are arranged at intervals of 1200 dpi. According to the present embodiment, the size of the heater 403 used for discharging a 5-pl ink droplet is approximately 21 square μm, the heater 404 (see FIG. 4) used for discharging a 2-pl ink droplet is approximately 19 square μm, and the heater 504 (see FIG. 5) used for discharging a 1-pl ink droplet is approximately 14 square μm.

Figure 4:
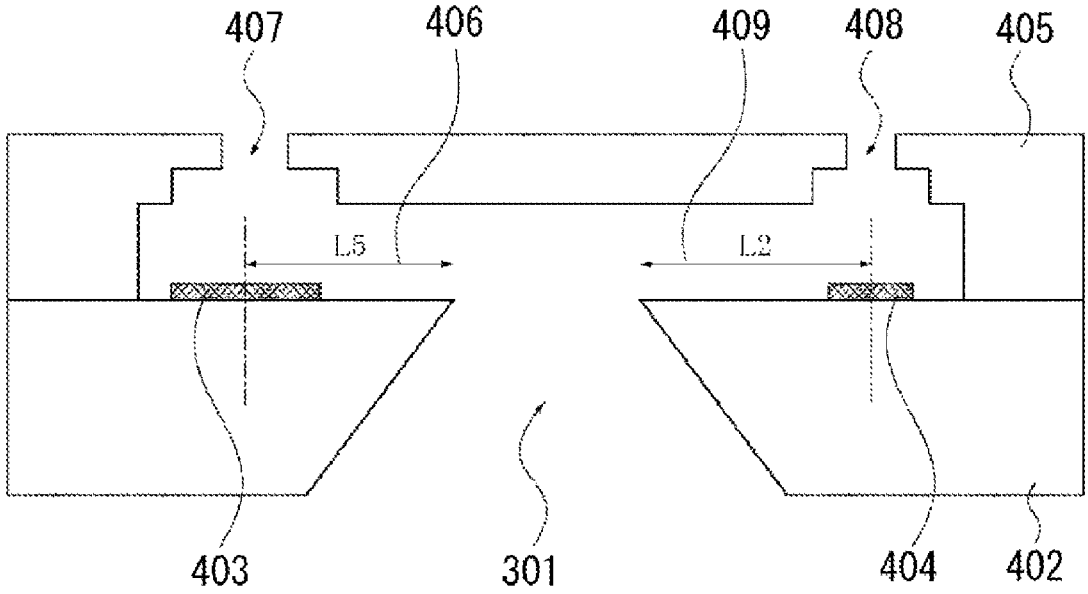
FIG. 4 illustrates the recording head according to the first exemplary embodiment of the present invention.
Figure 5:
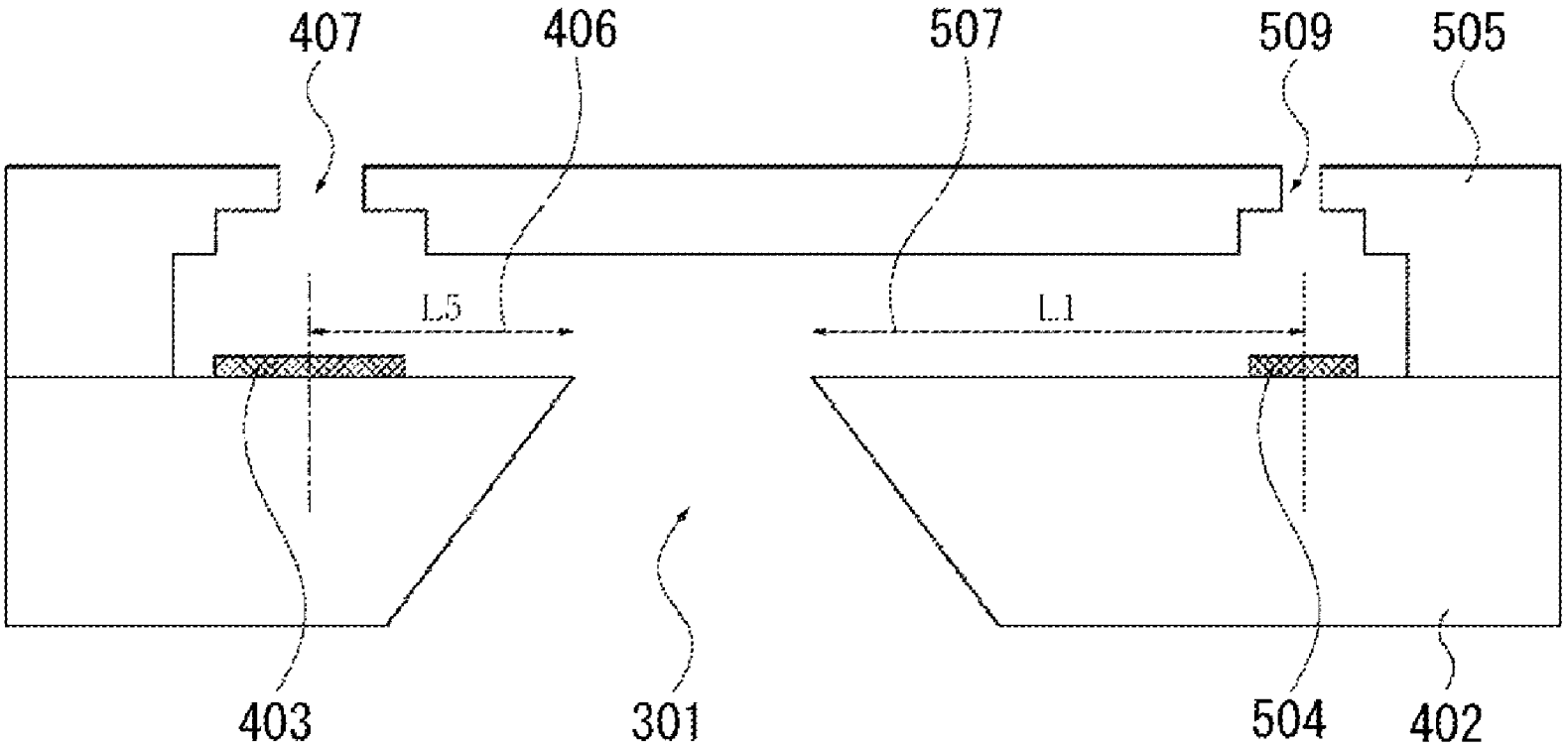
FIG. 5 illustrates the recording head according to the first exemplary embodiment of the present invention.

FIG. 4 is a cross-sectional view of the nozzles in FIG. 3 along a line 4-4. FIG. 5 is a cross-sectional view of the nozzles in FIG. 3 along a line 5-5.

In FIG. 4, the recording head includes a liquid supply port 301 configured to supply a liquid contained in the liquid container to each discharge port, a recording element substrate 402 made of silicon, the heaters 403 and 404 (heating elements) and a nozzle plate 405. According to the present embodiment, in a manufacturing process, the recording element substrate 402 is coated with a resin and then treated with a photolithography process to form ink channels 406 and 409 and the discharge ports 407 and 408. According to the present embodiment, a distance L5 from a top portion of the liquid supply port 301 to the center of the heater 403 and a distance L2 from a top portion of the liquid supply port 301 to the center of the heater 404 are substantially equal.

In FIG. 5, the recording head includes the liquid supply port 301, the recording element substrate 402 made of silicon, the heaters 403 and 504, and a nozzle plate 505. The channel 406 and the discharge port 407 are used for a 5-pl ink droplet, a channel 507 and a discharge port 509 are used for a 1-pl ink droplet. According to the present embodiment, a distance L1 from a top portion of the liquid supply port 301 to the center of heater 504 used for a 1-pl ink droplet is longer than the distance L5 from a top portion of the liquid supply port 301 to the center of the heater 403. The distances L5 and L2 are approximately 60 μm while the distance L1 is approximately 100 μm.

Figure 1:
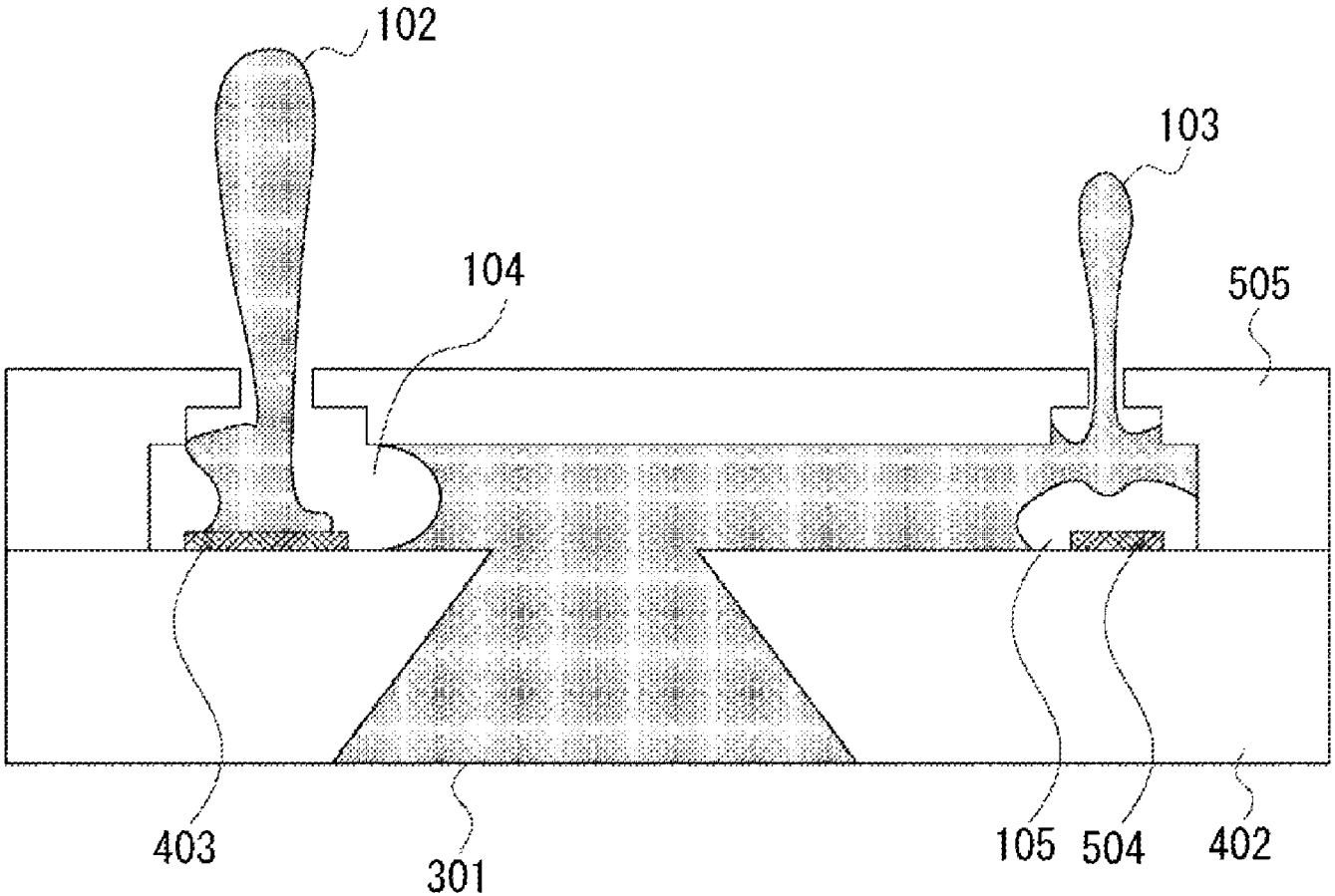
FIG. 1 illustrates an ink discharge system according to a first exemplary embodiment of the present invention.

A discharge of the ink jet recording head will be described referring to FIG. 1. The ink jet recording head as shown in cross section in FIG. 5 discharges 5-pl and 1-pl ink droplets. In FIG. 1, an ink droplet 102 is a 5-pl droplet to be discharged from the discharge port 407 and an ink droplet 103 is a 1-pl droplet to be discharged from the discharge port 509. The recording head includes a liquid supply port 301 configured to supply a liquid contained in the liquid container to each discharge port.

According to the present embodiment, energy is applied to the heaters 403 and 504 so that film boiling of the ink appears. The ink is discharged from the ink discharge port with the energy generated by the film boiling. A bubble illustrated in FIG. 1 is debubbling after the bubble grew to the maximum size in the film boiling.

As a portion 104 shows, a bubble generated by the film boiling and discharged from a nozzle of a 5-pl ink droplet communicates with the atmosphere at the time of debubbling. Referring to FIG. 1, a bubble 105 generated by the film boiling and discharged from a nozzle of a 1-pl ink droplet does not communicate with the atmosphere at the time of debubbling. Although not illustrated in the drawing, a bubble generated by the film boiling and discharged from a nozzle of a 2-pl ink droplet in the discharge method illustrated in FIG.

4 communicate with the atmosphere at the time of debubbling similar to the system in which a 5-pl ink droplet is discharged.

The above-described discharge system is employed in the present embodiment. The ink jet recording head is driven at 15 kHz and a unit pixel is formed by four scans. An amount of droplet discharge depends on density of pixel. A 2-pl ink droplet is used for a print having a density greater than a case where a unit pixel is struck by a 1-pl ink droplet. On the other hand, a 5-pl ink droplet is used for making a print with more density.

A 1-pl droplet by a plurality of scans may be discharged in simple discharging. However, image processing such as the error diffusion method is required in most cases for a high-quality image. In such a case, a 1-pl droplet can also be continuously discharged to a neighboring pixel. Thus, a larger margin can be provided with respect to a high-quality image if a refill frequency of a 1-pl droplet is set higher. Further, in many cases, a higher-quality image can be obtained by discharging a small droplet such as a 1-pl droplet for a number of times, compared to when a larger droplet is discharged.

According to the present embodiment, in order to sustain image reliability, many 1-pl droplets can be discharged while maintaining a state in which the variation in the discharge amount does not affect the image. If a bubble generated by a heater does not communicate with the atmosphere in the discharge system, a greater variation in the amount of discharge can occur compared to a discharge system where a bubble communicates with the atmosphere. However, in a case where the discharge amount is less than 2 pl, as in the discharge system according to the present embodiment, since the result of the discharge is almost invisible and the variation of discharge amount is not noticeable on a recording medium so that its adverse effect on image quality is small. Thus, in a case where a discharge is performed in an amount of less than 2 pl, it is possible to employ the discharge system that does not allow the bubble to communicate with the atmosphere.

On the other hand, the discharge system that does not allow a bubble to communicate with the atmosphere is useful since refill speed in such a system is faster as compared to a discharge system in which a bubble communicates with the atmosphere. Thus, the high refill speed is valued for the discharge of a 1-pl droplet. Therefore, the ink droplet discharging method is employed in which the debubbling occurs while the bubble does not communicate with the atmosphere.

An image significantly changes in the case of the discharge amount of 5 pl and 2 pl. In such a case, it is meaningful to emphasize the reduction of the variation in the discharge amount. Accordingly, a discharge system that allows a bubble generated by a drive of a heater to communicate with the atmosphere is suitable for this purpose. Further, an ink discharge system is more suitable in which the bubble begins communicating with the atmosphere for the first time when the bubble volume is decreasing after the bubble has reached the maximum size.

When the ink discharge system described in the present embodiment is employed, an ink jet recording method capable of printing a high-quality image at a high-speed can be achieved. The discharge system in which a bubble communicates or does not communicate with the atmosphere can be determined by changing parameters such as the distance between the heater and the discharge port face, heater size, discharge port size, and channel width.

According to the exemplary embodiment of the present invention, the arrangement density of the discharge ports 408 and 509 is set to 1200 dpi. When this density increases, the intervals between the discharge ports in the arrangement direction become narrow, which results in narrower channel width. In particular, in the recording system operating at a high arrangement density of more than or equal to 900 dpi, refilling becomes difficult. However, by implementing the configuration of the present invention, high-speed and a high-quality image printing can be achieved.

Second Exemplary Embodiment

Figure 7:
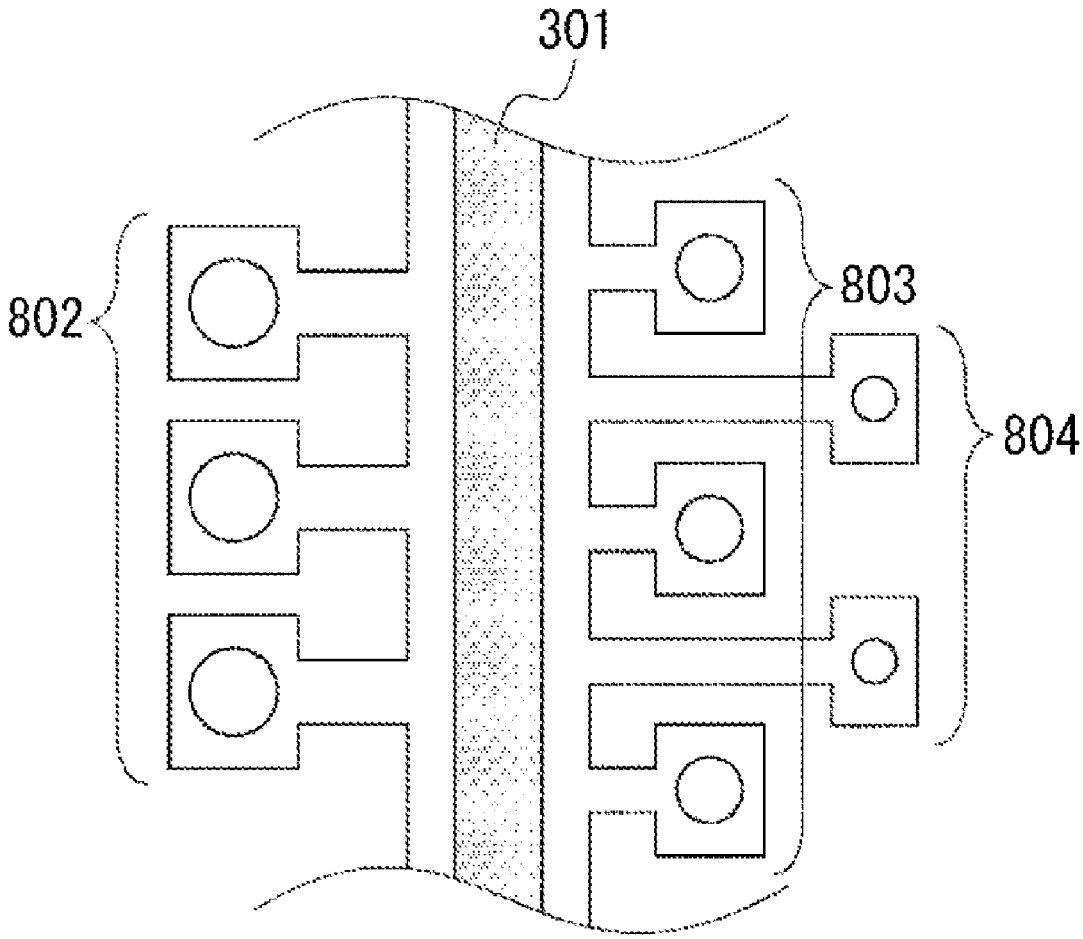
FIG. 7 illustrates a recording head according to a second exemplary embodiment of the present invention.

Next, a second exemplary embodiment of the present invention will be described. With reference to FIG. 7, the liquid supply port 301 supplies ink to each ink channel, and a nozzle array group 802 discharges a 2-pl ink droplet. A nozzle array group 803 discharges a 1-pl ink droplet, and nozzle array group 804 discharges a 0.6-pl ink droplet.

According to the present embodiment, in the ink discharge system employing the nozzle array group 802 that discharges a 2-pl ink droplet and a nozzle array group 803 that discharges a 1-pl ink droplet, a bubble generated by a drive of a heater communicates with the atmosphere for the first time when the volume is decreasing after the bubble has reached its maximum size. As for the nozzle array group 804 which discharges a 0.6-pl ink droplet, a bubble generated by a drive of a heater does not communicate with the atmosphere when the ink droplet is discharged.

According to the present embodiment, the distance from the liquid supply port to the heater (CH distance) of the nozzle array group 804, which discharges a 0.6-pl ink droplet, is longer than the nozzle array group 803.

Similar to the first exemplary embodiment, the bubble generated by the discharge system according to the present embodiment does not communicate with the atmosphere in a case where the amount of discharge is relatively small and the CH distance is relatively long. On the other hand, the bubble communicates with the atmosphere if the amount of discharge is large and if the CH distance of the recording head is relatively short. Thus, according to the configuration of the present invention, an ink jet recording method is provided that enables printing of a high-quality image at a high speed similar to the first exemplary embodiment.

Third Exemplary Embodiment

Figure 8:
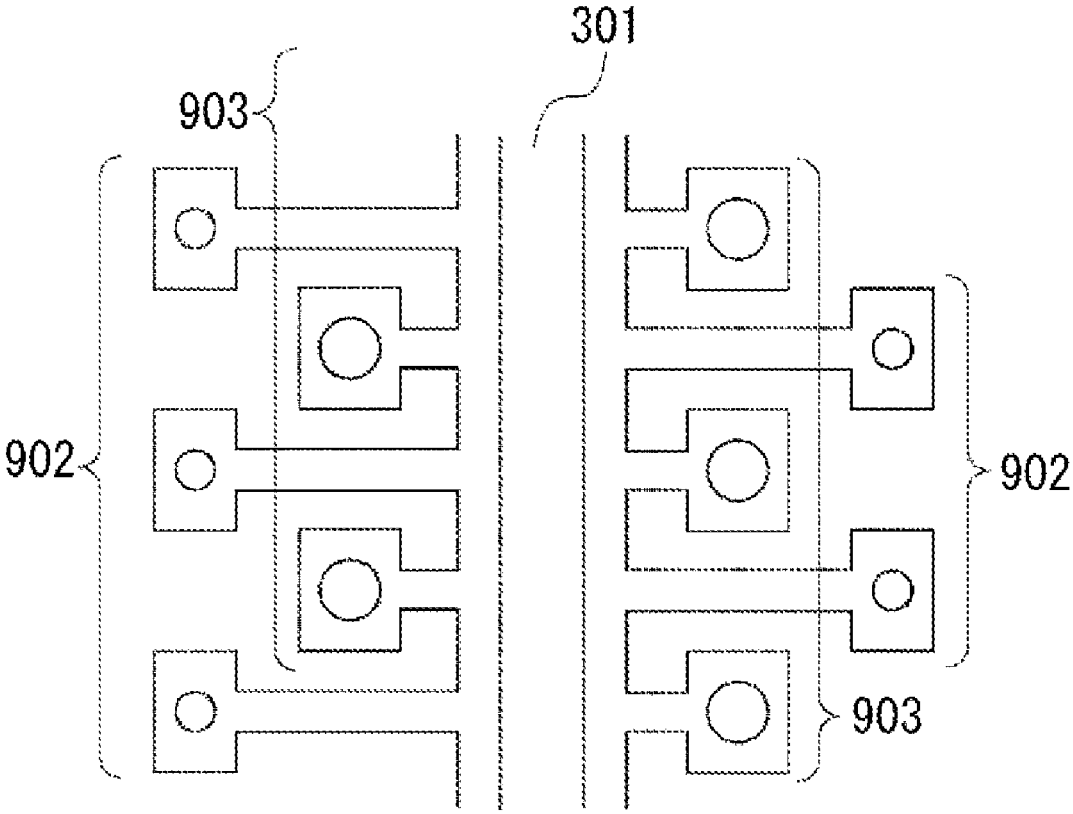
FIG. 8 illustrates a recording head according to a third exemplary embodiment of the present invention.

Next, a third exemplary embodiment of the present invention will be described. With reference to FIG. 8, the liquid supply port 301 supplies ink to each ink channel, a nozzle array group 902 discharges a 1-pl ink droplet, and a nozzle array group 903 discharges a 2-pl ink droplet. According to the present embodiment, nozzles that discharge 1 pl of ink droplet and nozzles that discharge 2 pl of ink droplet are alternately arranged with the liquid supply port 301 sandwiched therebetween.

Further, on the right or the left side of the liquid supply port 301, nozzles that discharge 1 pl of ink droplet and nozzles that discharge 2 pl of ink droplet are arranged side by side at intervals of 1200 dpi. Similar to the foregoing exemplary embodiments, in a case where the nozzle array group 903 discharges a 2-pl ink droplet, a bubble generated by a drive of a heater communicates with the atmosphere for the first time when the volume is decreasing after the bubble has reached its maximum size.

In a case where the nozzle array group 902 discharges a 1-pl ink droplet, a bubble generated by a drive of a heater does not communicate with the atmosphere when the ink droplet is discharged. Thus, according to the configuration of the present invention, it is possible to provide an ink jet recording method that enables printing of a high-quality image at a high speed, similar to the foregoing exemplary embodiment.

Figure 6:
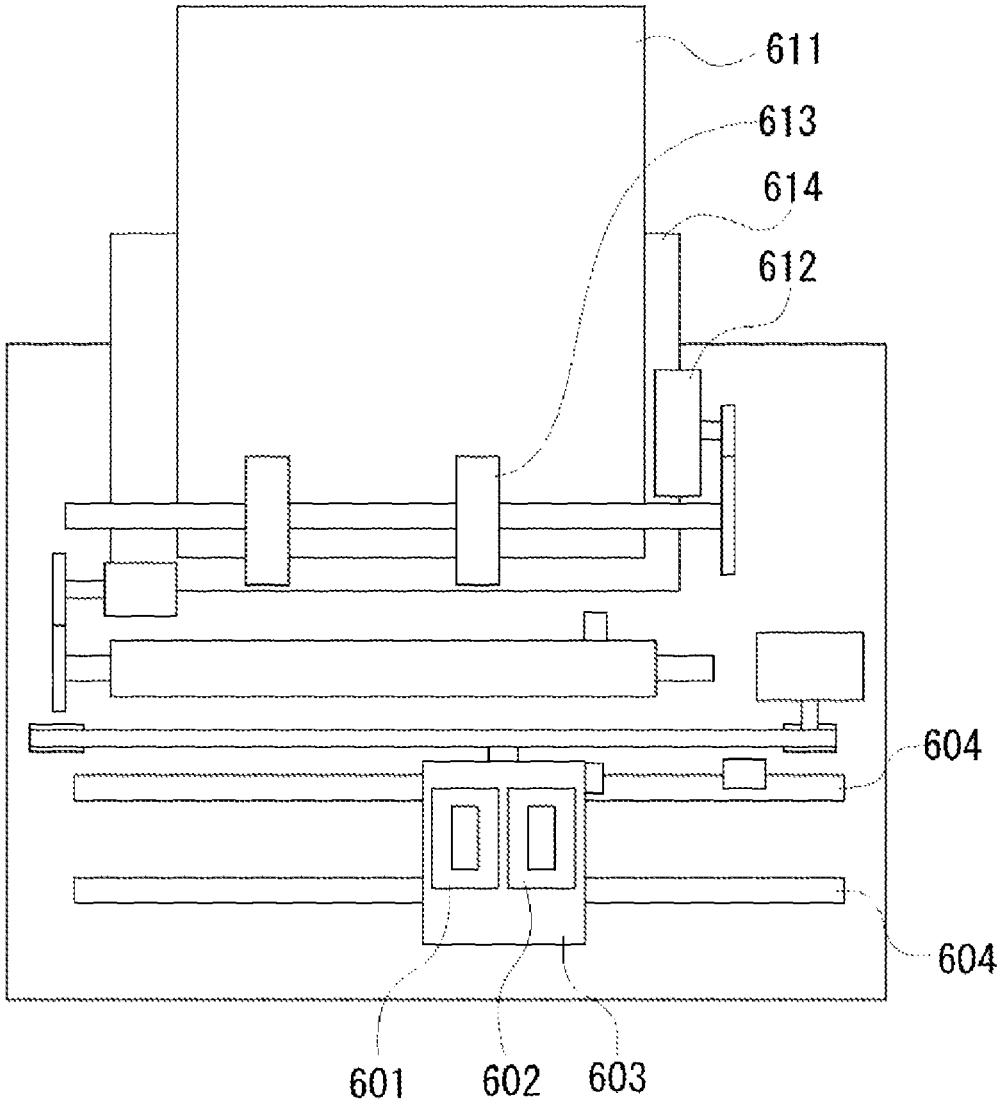
FIG. 6 is a perspective view illustrating an ink jet recording apparatus according to an exemplary embodiment of the present invention.

The recording apparatus into which the aforementioned ink jet recording cartridge can be installed will be described referring to FIG. 6. FIG. 6 is a schematic view of the ink jet recording apparatus. The ink jet recording cartridges 601 and 602 are positioned and mounted replaceably on a carriage 603.

According to the present embodiment, the ink jet recording cartridge 601 is a black cartridge for discharge of black ink and the ink jet recording cartridge 602 is a color cartridge for discharge of yellow, magenta, and cyan ink. An electric connection portion is provided on the carriage 603. The electric connection portion transmits an electric signal to each discharge portion through an external signal input terminal of the ink jet recording cartridges 601 and 602.

The carriage 603 is guided and supported by and along a guide shaft 604 in a reciprocating direction. The guide shaft 604 is placed on the apparatus main body extending in a main scanning direction. A recording medium 611 such as print paper or a plastic sheet is fed from an auto sheet feeder 614 one after another while a pick up roller 613 is driven by a paper feeding motor 612 via a gear.

The ink jet recording cartridges 601 and 602 are mounted on the carriage 603 so that each discharge port in the discharge portion is aligned perpendicular to the scan direction of the carriage 603. The ink is discharged from this array of discharge ports for recording an image.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2006-341123 filed Dec. 19, 2006, which is hereby incorporated by reference herein in its entirety.

What is claimed is:

1. A method for discharging liquid from a recording head comprising:

preparing a recording head comprising:

a first discharge port configured to discharge a liquid supplied from a liquid supply port;

a second discharge port configured to discharge a liquid, an amount of which is smaller than an amount of the liquid discharged from the first discharge port; and a substrate including a first heating element corresponding to the first discharge port, a second heating element corresponding to the second discharge port and the liquid supply port, wherein a distance between the liquid supply port and the second heating element is longer than a distance between the liquid supply port and the first heating element;

communicating by a bubble formed in the liquid by driving the first heating element with atmosphere, and discharging liquid from the first discharge port; and debubbling of a bubble formed in the liquid by driving the second heating element, without communicating with atmosphere, and discharging an amount of the liquid less than 2 pico liters from the second discharge port.

2. The method according to claim 1, wherein the first discharge port and the second discharge port are alternately arranged on the same side opposing the liquid supply port.

3. The method according to claim 2, wherein a discharge port array comprising the first discharge port and the second discharge port has an arrangement density of more than or equal to 900 dpi.

4. The method according to claim 1, wherein a third discharge port discharges an amount of liquid which is larger than the amount of liquid discharged from the first discharge port, and wherein the third discharge port is arranged across the liquid supply port on a side opposite to the side on which the first and the second discharge ports are arranged.

5. The method according to claim 1, wherein the recording head includes a first liquid channel for supplying a liquid from the liquid supply port to the first heating element and a second liquid channel for supplying a liquid from the liquid supply port to the second heating element, the first liquid channel being shorter than the second liquid channel.

6. An apparatus for discharging liquid from a recording head comprising:

a first discharge port configured to discharge a liquid supplied from a liquid supply port;

a second discharge port configured to discharge a liquid, an amount of which is smaller than an amount of the liquid discharged from the first discharge port; and a substrate including a first heating element corresponding to the first discharge port, a second heating element corresponding to the second discharge port and the liquid supply port, wherein a distance between the liquid supply port and the second heating element is longer than a distance between the liquid supply port and the first heating element, wherein discharge of the liquid from the first discharge port is performed by a discharge method in which a bubble formed by the first heating element communicates with atmosphere, and wherein an amount of the liquid discharged from the second discharge port is less than 2 pico liters, and discharge of the liquid from the second discharge port is performed by a discharge method in which a bubble formed by the second heating element debubbles without communicating with the atmosphere.

7. The apparatus according to claim 6, wherein the recording head includes a first liquid channel for supplying a liquid from the liquid supply port to the first heating element and a second liquid channel for supplying a liquid from the liquid supply port to the second heating element, the first liquid channel being shorter than the second liquid channel.

* * * * *